US008690147B2

(12) United States Patent
Okuchi et al.

(10) Patent No.: US 8,690,147 B2
(45) Date of Patent: Apr. 8, 2014

(54) SHEET STACKABLE DEVICES

(75) Inventors: Hiroyuki Okuchi, Aichi (JP); Hiroshi Nobe, Aichi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/537,230

(22) Filed: Jun. 29, 2012

(65) Prior Publication Data

US 2013/0032989 A1 Feb. 7, 2013

(30) Foreign Application Priority Data

Aug. 5, 2011 (JP) ..... 2011-172364

(51) Int. Cl.
*B65H 1/00* (2006.01)

(52) U.S. Cl.
USPC ..... 271/9.09; 271/162

(58) Field of Classification Search
USPC ..... 271/9.09, 145, 162; 399/392
See application file for complete search history.

(56) References Cited

U.S. PATENT DOCUMENTS

| | | | | |
|---|---|---|---|---|
| 2008/0038030 | A1* | 2/2008 | Naito et al. | 399/392 |
| 2008/0128975 | A1* | 6/2008 | Sosnowski et al. | 271/162 |
| 2009/0309296 | A1* | 12/2009 | Taki et al. | 271/220 |
| 2010/0289213 | A1* | 11/2010 | Yahata | 271/314 |
| 2012/0175838 | A1* | 7/2012 | Nakamura et al. | 271/9.11 |
| 2012/0200031 | A1* | 8/2012 | Yahata et al. | 271/314 |

FOREIGN PATENT DOCUMENTS

JP 2011-011860 1/2011

* cited by examiner

*Primary Examiner* — Jeremy R Severson
(74) *Attorney, Agent, or Firm* — Banner & Witcoff, Ltd.

(57) ABSTRACT

A sheet stackable device includes a sheet stackable plane. The sheet stackable device includes a first tray and a second tray, each of which is formed in a shape of a flat plate. The first tray includes a first contact part. The second tray is slidable along a slidable direction between a first position, in which the second tray overlaps the first tray, and a second position, in which the second tray is dawn out of the first tray. The second tray includes a second contact part, which is slidable on the first contact part. At least one of the first contact part and the second contact part includes a rack with rack teeth, which are aligned along the slidable direction. An upper plane of the first tray and an upper plane of the second tray in the second position form at least a part of the stackable plane.

15 Claims, 10 Drawing Sheets

SHEET STACKABLE DEVICES

CROSS REFERENCE TO RELATED APPLICATION

This application claims priority from Japanese Patent Application No. 2011-172364, filed on Aug. 5, 2011, the entire subject matter of which is incorporated herein by reference.

BACKGROUND

1. Technical Field

An aspect of the present disclosure relates to a sheet stackable device.

2. Related Art

A sheet stackable device is disclosed in, for example, Japanese Patent Provisional Publication No. 2011-11860. According to disclosure in the publication, the sheet stackable device includes a first tray and a second tray which are thinly formed to have shapes of flat plates. The second tray is slidably supported by the first tray and is slidable between a first position, in which the second tray is situated to overlap the first tray and a second position, in which the second tray is drawn out of the first tray.

Further, according to the publication, the first tray and the second tray are provided with a first contact section and a second contact section respectively, which are in slidably contact with each other when the second tray is drawn out of or placed back in the first position. The first contact section and the second contact section are formed to extend in planes, and the planar sections slidably contact with each other when the second tray slides with respect to the first tray.

In the conventional sheet stackable device with such configuration, an upper plane of the first tray and an upper plane of the second tray placed in the second position serve contiguously as at least a part of a stackable plane, on which sheets can be stacked.

SUMMARY

In the conventional sheet stackable device, however, when the first tray slides with respect to the first tray, the planar parts of the first contact section and the second contact section may frictionally contact each other and may produce unpleasant noise such as squeaky high-frequency sound.

Aspects of the disclosure is advantageous in that a sheet stackable device, in which the unpleasant noise can be reduced, is provided.

According to an aspect of the present disclosure, a sheet stackable device having a sheet stackable plane, which is configured to place a sheet thereon, is provided. The sheet stackable device includes a first tray, which is formed in a shape of a flat plate and formed to have a first contact part, and a second tray, which is formed in a shape of a flat plate. The second tray is configured to be supported by the first tray to be slidable along a slidable direction between a first position, in which the second tray vertically overlaps the first tray, and a second position, in which the second tray is dawn out of the first tray, and formed to have a second contact part, which is slidable on the first contact part. At least one of the first contact part and the second contact part includes a rack with rack teeth, which are formed to align along the slidable direction. An upper plane of the first tray and an upper plane of the second tray in the second position form at least a part of the stackable plane.

BRIEF DESCRIPTION OF THE ACCOMPANYING DRAWINGS

DETAILED DESCRIPTION

Hereinafter, embodiments of the present disclosure will be described with reference to the accompanying drawings. In the following description, two or more same or similar components may be referred to by an identical reference sign, and description of one of those same or similar components may represent the remaining components.

An Embodiment

Figure 1:
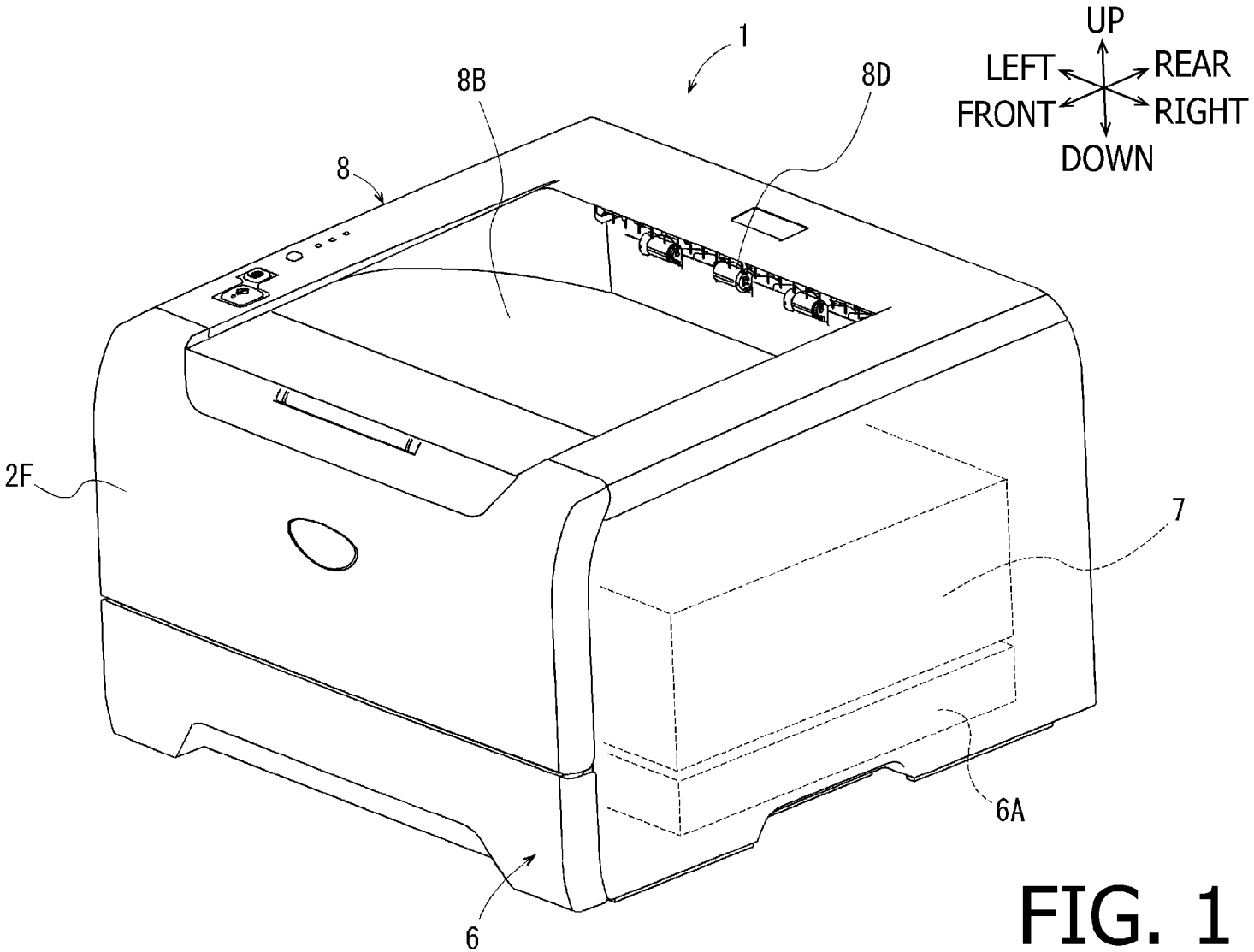
FIG. 1 is a perspective view of a sheet stackable device according to an embodiment of the present disclosure.

A printer 1 according to an embodiment of the present disclosure is shown in FIG. 1. In the present embodiment, directions concerning the printer 1 will be referred to based on the orientation indicated by arrows shown in each drawing. In particular, a viewer's nearer left side in FIG. 1, on which a front cover 2F is arranged, is referred to as front, and a side, which comes on a user's left-hand side with respect to the printer 1 when the user faces the front cover 2F, is referred to as left. Therefore, a side opposite from the front, which is on the viewer's further right side in FIG. 1 is referred to as rear, and a side opposite from the left, which is on the viewer's nearer right side is referred to as right. The right-left direction of the printer 1 may also be referred to as a widthwise direction or a direction of sheet-width. The up-down direction in FIG. 1 corresponds to a vertical direction of the printer 1. The orientations shown in FIGS. 2-10 correspond to those indicated by the arrows appearing in FIG. 1. A configuration of the printer 1 according to the embodiments of the present disclosure will be described hereinbelow with reference to FIGS. 1-10.

As shown in FIG. 1, the printer 1 includes a box-like shaped housing 8, an image forming unit 7 stored in the housing 8, and a sheet cassette 6 which is detachably attached to the housing 8.

The image forming unit 7 forms an image on a sheet of, for example, paper or OHP film in a known image forming method such as an electrophotographic method, thermally, or in inkjet. Detailed description of the image forming unit 7 is herein omitted.

The sheet cassette 6 includes a sheet container 6A, which is arranged in a lower position with respect to the image forming unit 7 when the sheet cassette 6 is attached to the housing 8. In the sheet container 6A, one or a plurality sheets in a stack can be stored.

The printer 1 further includes a sheet feeder (not shown), a discharge tray 8B, which is a pit formed in a top plane of the housing 8, and a discharge roller 8D, which rotates to discharge the sheet in the discharge tray 8B. The sheet feeder is a known sheet feeding device including a sheet-feed roller, a separator roller, and a separator pad. Illustration and description of the sheet feeder is herein omitted.

When images are formed on the sheets stored in the sheet container 6A, the sheet feeder, the image forming unit 7, and the discharge roller 8D are manipulated by a controller (not shown) to work in cooperation with one another. Accordingly, the sheets in the sheet container 6A are separated one-by-one and forwarded to the image forming unit 7, and the image forming unit 7 forms an image on each sheet having been conveyed. The sheet with the image formed thereon is carried by the discharge roller 8D to be discharged in the discharge tray 8B.

Figure 2:
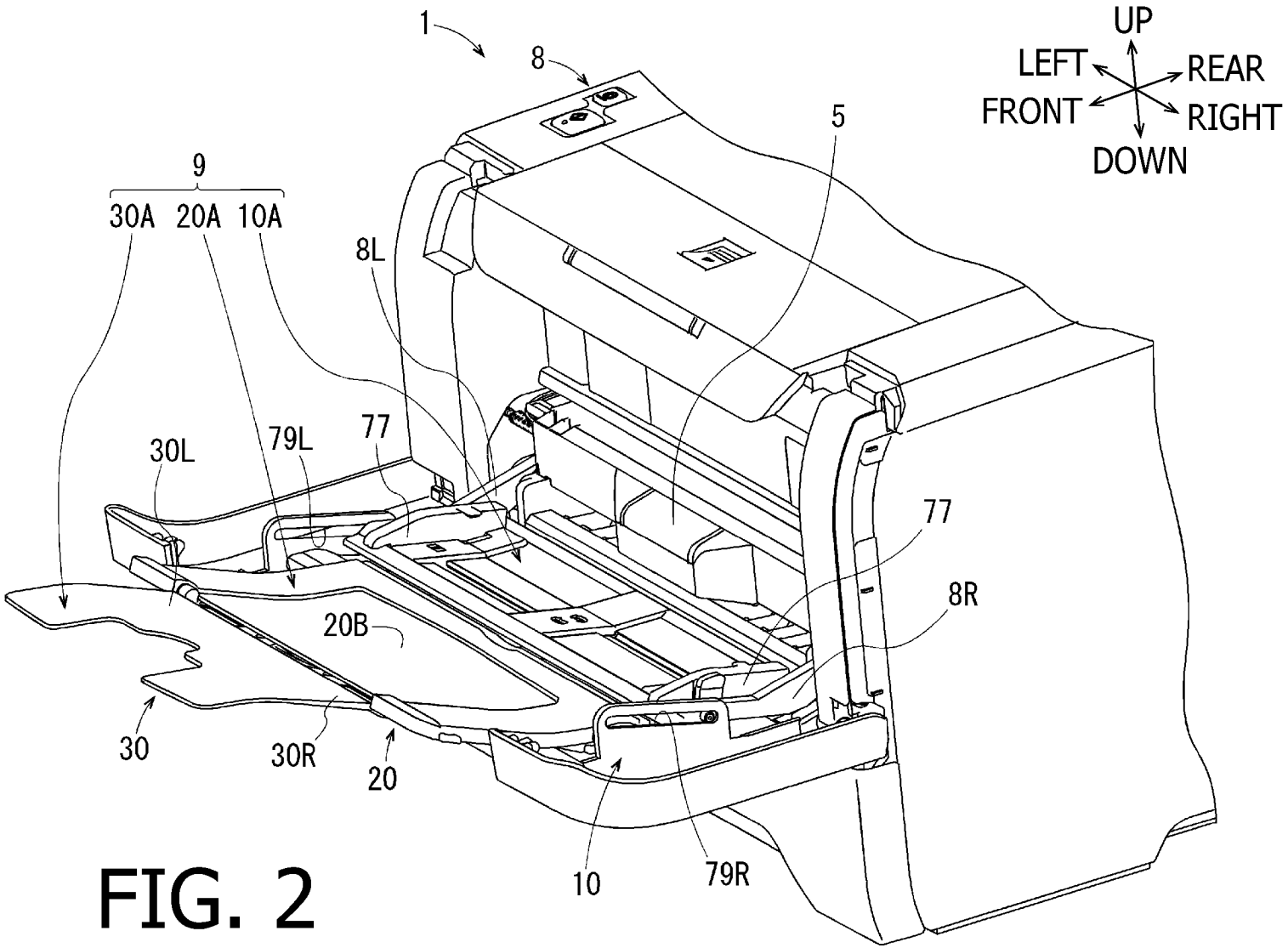
FIG. 2 is a partial perspective view of the sheet stackable device according to the embodiment of the present disclosure.

Further to the sheet cassette 6, the printer 1 has an extensible first tray 10, a second tray 20, and a third tray 30, which can be extended outward (see FIG. 2), to hold sheets to be manually inserted through a front part of the housing 8. In the following description, the orientation (e.g., front, rear, right, left, up, and down) of the first tray 10, the second tray 20, and the third tray 30 will be mentioned based on the extended postures of the first tray 10, the second tray 20, and the third tray 30 as shown in FIG. 2.

The first tray 10, the second tray 20, and the third tray 30 are made of resin and formed in flat plates. The "flat" shapes of the first tray 10, the second tray 20, and the third tray 30 may not necessarily mean plain evenness but may include enhancing ribs and other depressions and protuberances, and the first tray 10, the second tray 20, and the third tray 30 may be formed in nearly flat plates. When the first tray 10, the second tray 20, and the third tray 30 are extended, upper surfaces 10A, 20A, 30A of the first tray 10, the second tray 20, and the third tray 30 continuously form a stackable plane 9, which extends frontward from the front part of the housing 8. The sheets to be manually fed in the printer 1 are placed on the stackable plane 9.

Inside the housing 8, in a frontward position with respect to the image forming unit 7, a sheet conveyer 5 is arranged. The sheet conveyer 5 is a known sheet conveying device including, similarly to the sheet feeder, a feeder roller, a separator roller, and a separator pad. Illustration and description of the sheet feeder is herein omitted.

When images are formed on the sheets placed on the stackable plane 9, the sheet conveyer 5, the image forming unit 7, and the discharge roller 8D are manipulated by the controller to work in cooperation with one another. Accordingly, the sheets on the stackable plane 9 are separated one-by-one and forwarded to the image forming unit 7, and the image forming unit 7 forms an image on each sheet having been conveyed. The sheet with the image formed thereon is carried by the discharge roller 8D to be discharged in the discharge tray 8B.

A position of the first tray 10 extended frontward to protrude in a sidelong posture from the front part of the housing 8 (see FIG. 2) is referred to as a second position for the first tray 10 in the present embodiment. On the upper surface 10A of the first tray 10 in the second position, sheet-restrictive guides 77 are attached. The sheet-restrictive guides 77 restrict widthwise positions of the sheets to be placed on the stackable plane 9. Further, on an underside opposite from the upper surface 10A of the first tray 10 in the second position, the front cover 2F (see FIG. 1) being a front panel for the housing 8 is attached. In the first tray 10 shown in FIGS. 3-5 and 7-8, the attachments (e.g., the sheet-restrictive guides 77 and the front cover 2F) are omitted.

Figure 3:
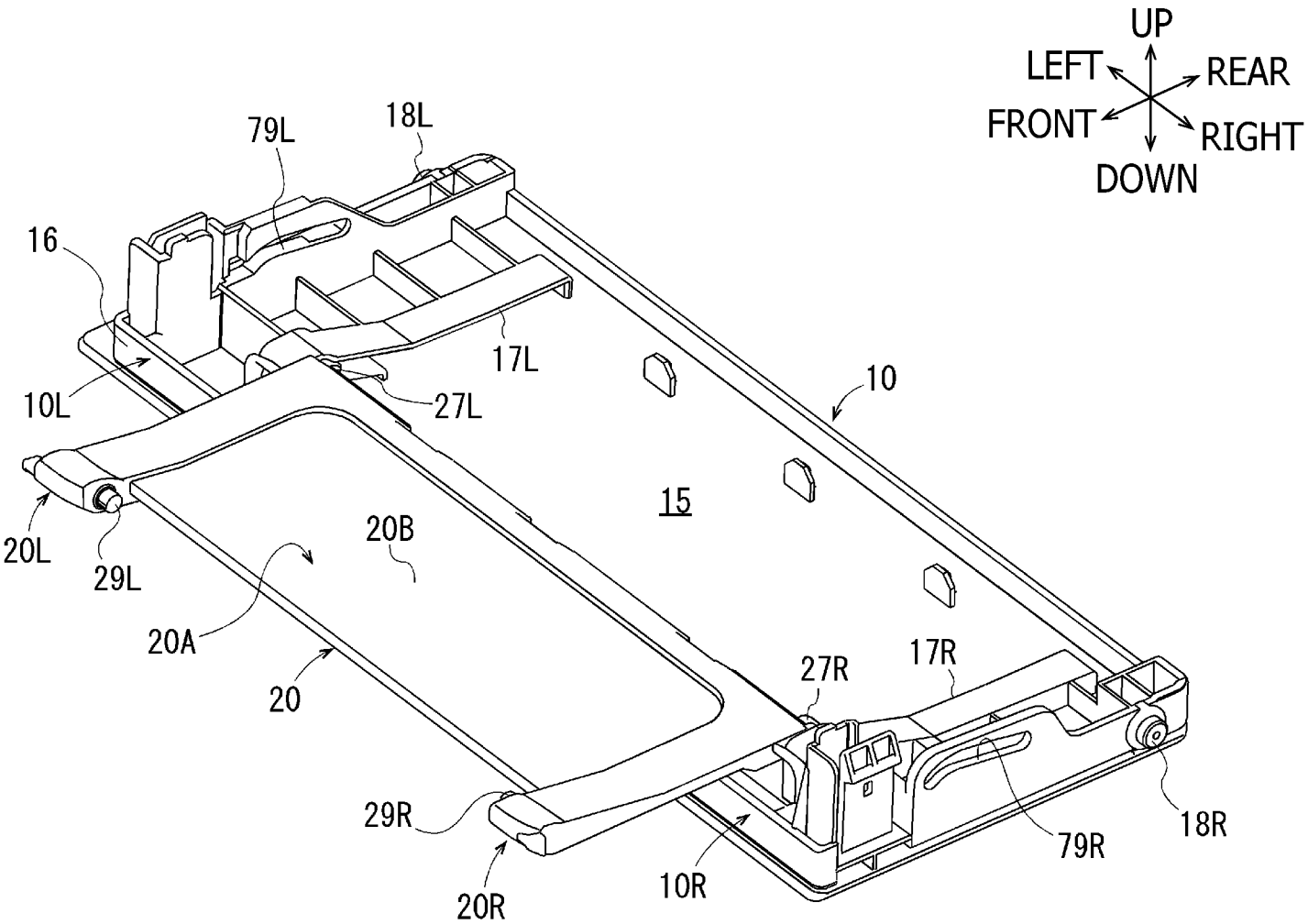
FIG. 3 is a perspective view of a first tray and a second tray in the sheet stackable device according to the embodiment of the present disclosure.
Figure 5:
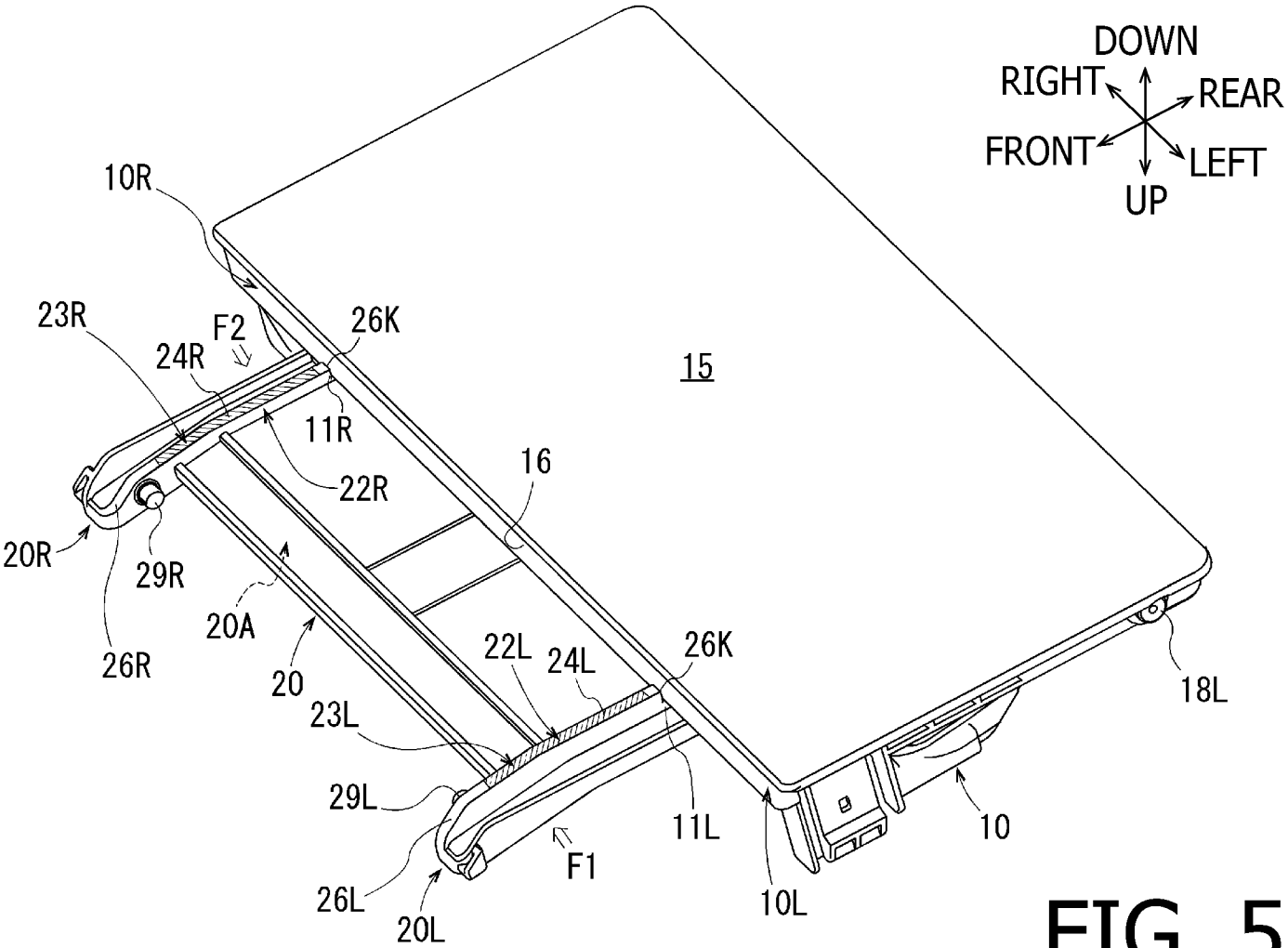
FIG. 5 is a perspective view of the first tray and the second tray in the sheet stackable device according to the embodiment of the present disclosure.
Figure 9:
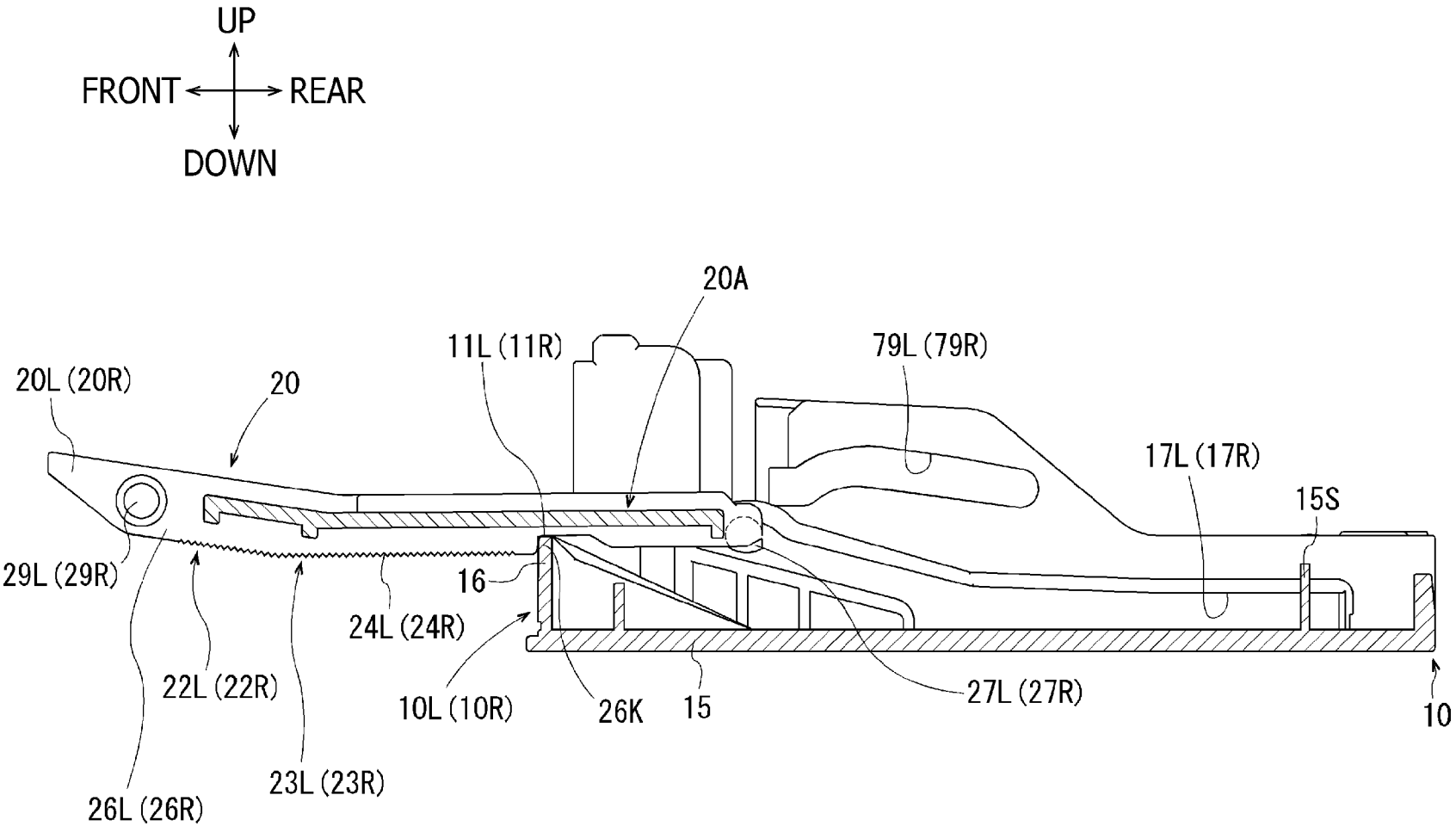
FIG. 9 is a cross-sectional side view of the second tray taken along the line A-A shown in FIG. 6 and the first tray in the sheet stackable device according to the embodiment of the present disclosure.

A position of the second tray 20 extended frontward with respect to the first tray 10 (see FIG. 2) is referred to as a second position for the second tray 20 in the present embodiment. In FIGS. 3, 5, and 9, the second tray 20 alone is shown. As will be described later in greater detail, the second tray 20 can be slid rearward with respect to the first tray 10, which is in the second position, to a first position (see FIG. 7). In the first position, the second tray 20 is situated on top of the first tray to vertically overlap from above. From the first position, the second tray 20 can be slid frontward with respect to the first tray 10 being in the second position to the second position, in which the second tray 20 is drawn out of the first tray 10.

Figure 7:
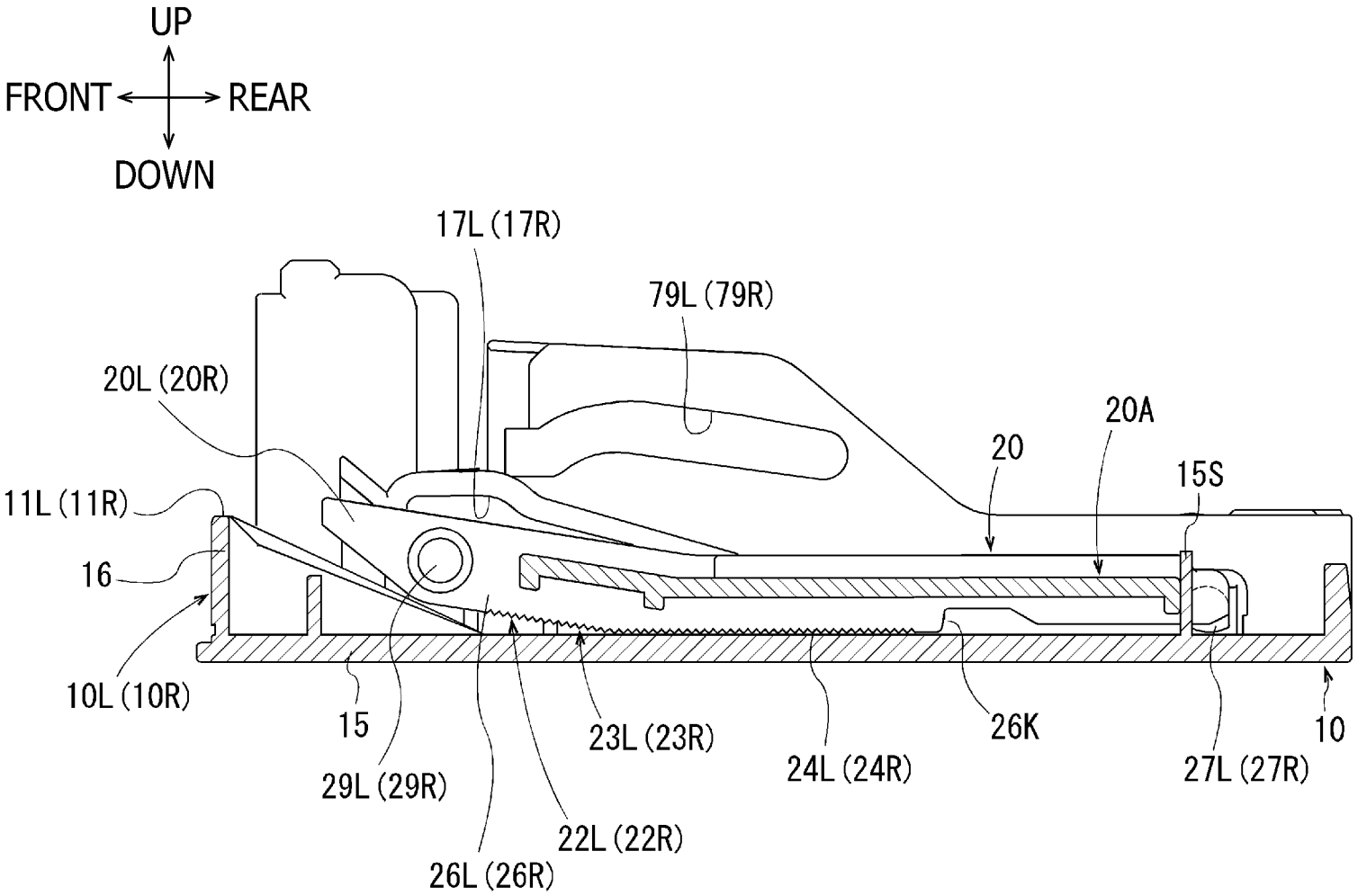
FIG. 7 is a cross-sectional side view of the second tray taken along a line A-A shown in FIG. 6 and the first tray in the sheet stackable device according to the embodiment of the present disclosure.
Figure 8:
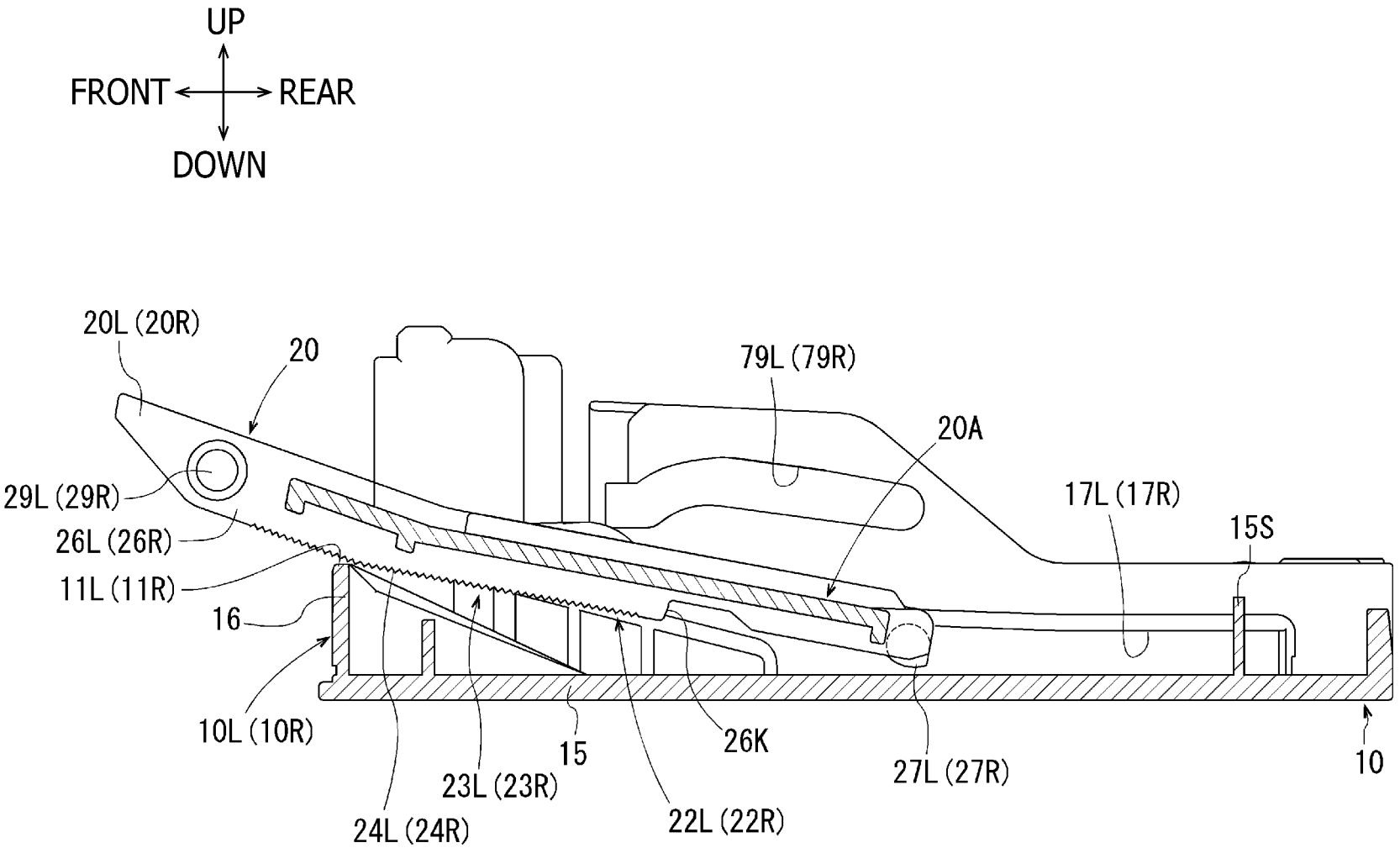
FIG. 8 is a cross-sectional side view of the second tray taken along the line A-A shown in FIG. 6 and the first tray in the sheet stackable device according to the embodiment of the present disclosure.

In the present embodiment, a slidable direction of the second tray 20 to slide with respect to the first tray 10 being in the second position coincides with the front-rear direction (see FIGS. 7-9). The slidable direction is in parallel with a conveying direction, along which the sheet placed on the stackable plane 9 is conveyed by the sheet conveyer 5. It is to be noted, however, that the term "parallel" may mean "substantially parallel" whilst the second tray 20 may slide in a slightly displaced direction with respect to the conveying direction, and each sheet may be conveyed in a slightly varied direction. Similarly, a term "orthogonal" may mean "substantially orthogonal." In the present embodiment, a direction of width of the sheet, which is placed on the stackable plane 9 to be conveyed, coincides with the right-left direction and is orthogonal to the sheet conveying direction. Further, the widthwise direction of the sheet is orthogonal to the slidable direction of the second tray 20.

The second tray 20 is formed to have rotation shafts 29R, 29L (see FIGS. 3, 5, and 6) on inner sides of front edges 20R, 20L thereof. The rotation shafts 29R, 29L coaxially protrudes inward toward each other along the right-left direction. The second tray 20 is further formed to have a shallowly-lowered fit-in area 20B on the upper surface 20A of the second tray 20A (see FIGS. 2 and 3).

A position of the third tray 30 extended frontward with respect to the second tray 20 (see FIG. 2) is referred to as a second position for the third tray 30 in the present embodiment. The third tray 30 is attached swingably with respect to the second tray 20. More specifically, right and left rear edges 30R, 30L of the third tray 30 are swingably supported by the rotation shafts 29R, 29L respectively. The "rear" edges 30R, 30L refer to the edges that are closer to the rear side of the printer 1 when the third tray 30 is in the second position (see FIG. 2). The third tray 30 may be pivoted about the rotation shafts 29R, 29L to be fitted in the fit-in area 20B from above to vertically overlap a part of the second tray 20. Thus, although not shown, in the fit-in area 20B, the third tray 30 can be housed in the second tray 20.

The first tray 10 is formed to have swing shafts 18R, 18L (see FIGS. 3-5) on outer lateral sides at rear corners thereof. The swing shafts 18R, 18L coaxially protrudes outward in opposite directions from each other. Further, the first tray 10 is formed to have guide grooves 79R, 79L in frontward positions with respect to the swing shafts 18R, 18L respectively. The guide grooves 79R, 79L are elongated openings extending along the front-rear direction on the lateral sides of the first tray 10. The swing shafts 18R, 18L are swingably supported by the front part of the housing 8. The guide grooves 79R, 79L are engaged with front ends of link levers 8R, 8L (see FIG. 2), which extend frontward from the front part of the housing 8, respectively.

With the above-described structure, the first tray 10 can swing about the swing shafts 18R, 18L to move from the second position (see FIG. 2), in which the first tray 10 projects frontward to a covering position (see FIG. 1), in which the first tray 10 is in an upright posture with a front edge thereof moved upward to align the front part of the housing 8. Especially, with the third tray 30 first in the fit-in area 20B of the second tray 20, and with the second tray 20 in the first position (see FIG. 7), when the first tray 10 is in the covering position, the front cover 2F attached to the first tray 10 serves as a front face of the housing 8. Thus, the front cover 2F covering the first tray 10, the second tray 20, the third tray 30, and the sheet conveyer 5 can improve an exterior appearance of the printer 1.

Next, the slidable configuration of the second tray 20 with respect to the first tray 10 from the first position to the second position will be described in detail.

Figure 4:
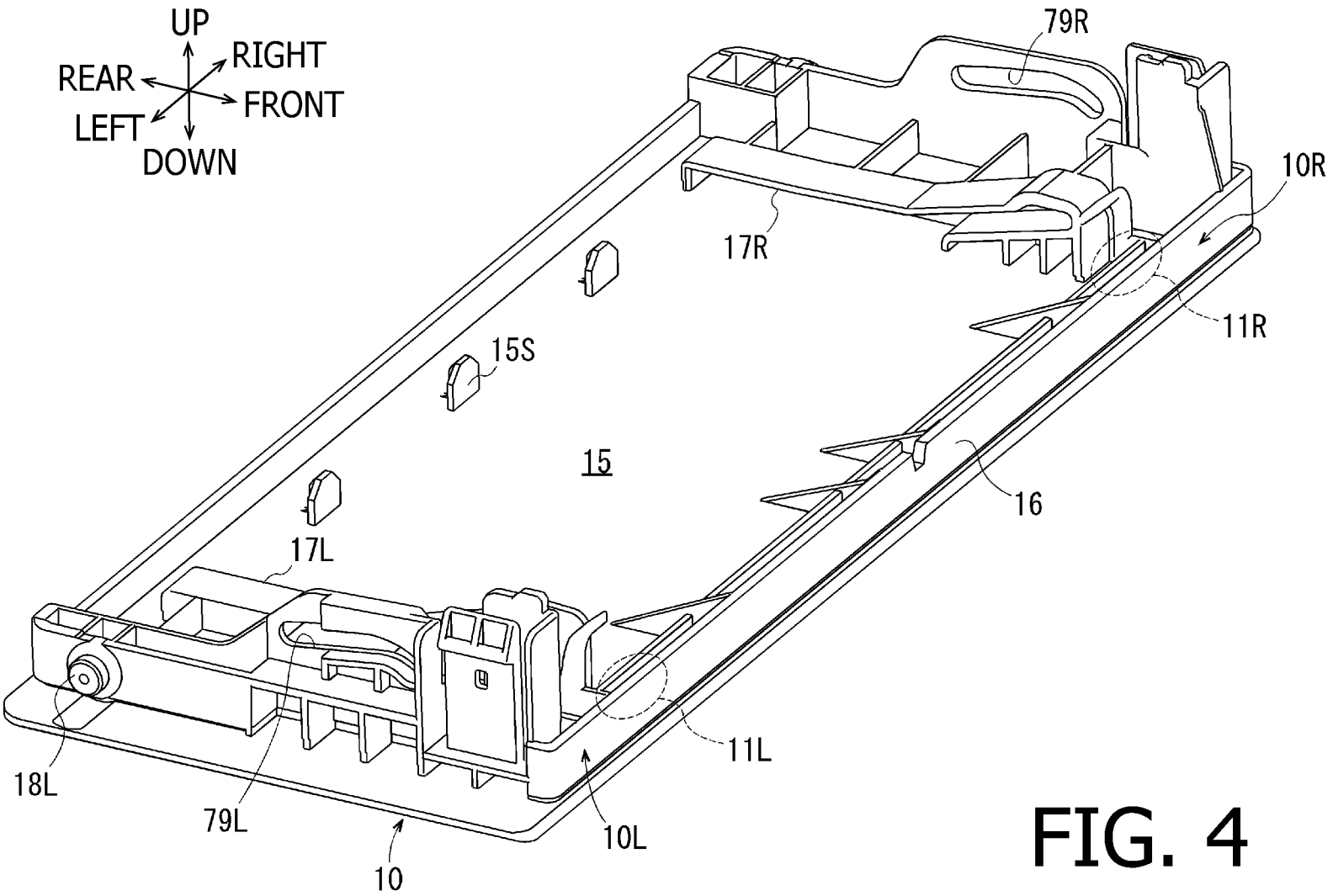
FIG. 4 is a perspective view of the first tray in the sheet stackable device according to the embodiment of the present disclosure.

As shown in FIGS. 3 and 4, the first tray 10 is formed to have guide rails 17R, 17L on right and left inner sides of the guide grooves 79R, 79L respectively. The guide rails 17R, 17L are formed to extend frontward from a rear side of the first tray 10 along a bottom plane 15 of the first tray 10 and are angled to incline to be higher at a front side of the first tray 10.

As shown in FIG. 4, the first tray 10 is formed to have an outer rim 16, which erects upward from the bottom plane 15, on the front edge thereof. The outer rim 16 extends upwardly from the bottom plane 15 of the first tray 10 and laterally along the right-left direction. An upper edge of the outer rim 16 forms a thinly elongated flat plane, which extends along the right-left direction.

The upper edge of the outer rim 16 includes a first contact part 11R, which can be in slidable contact with a second contact part 22R of the second tray 20, in a right-side end portion 10R of the first tray 10. Further, the upper edge of the outer rim 16 includes a first contact part 11L, which can be in slidable contact with a second contact part 22L of the second tray 20, in a left-side end portion 10L of the first tray 10. In other words, the first tray 10 includes the first contact parts 11R, 11L, which can be slidably in contact with the second tray 20 when the second tray 20 slides with respect to the first tray 10, on the upper plane thereof being one of an upper plane and a lower plane of the first tray 10 between the vertically overlapping planes of the first and second trays 10, 20.

In positions in vicinities of the rear edge of the first tray 10, stoppers 15S are provided. The stoppers 15S are formed to protrude upward from the bottom plane 15 of the first tray 10. When the second tray 20 is slid to the first position, the second tray 20 contacts the stoppers 15S to be placed in the correct first position.

The second tray 20 is formed to have guide shafts 27R, 27L (see FIG. 6) on right and left corners on the rear edge thereof. The guide shafts 27R, 27L coaxially protrudes outward in opposite directions from each other and can be inserted under the guide rails 17R, 17R respectively (see FIG. 3). When the second tray 20 is slid with respect to the first tray 10, the guide shafts 27R, 27L slide along the guide rails 17R, 17L (see FIGS. 7-9), and the rear edge of the second tray 20 is directed to move along the guide rails 17R, 17L.

Figure 6:
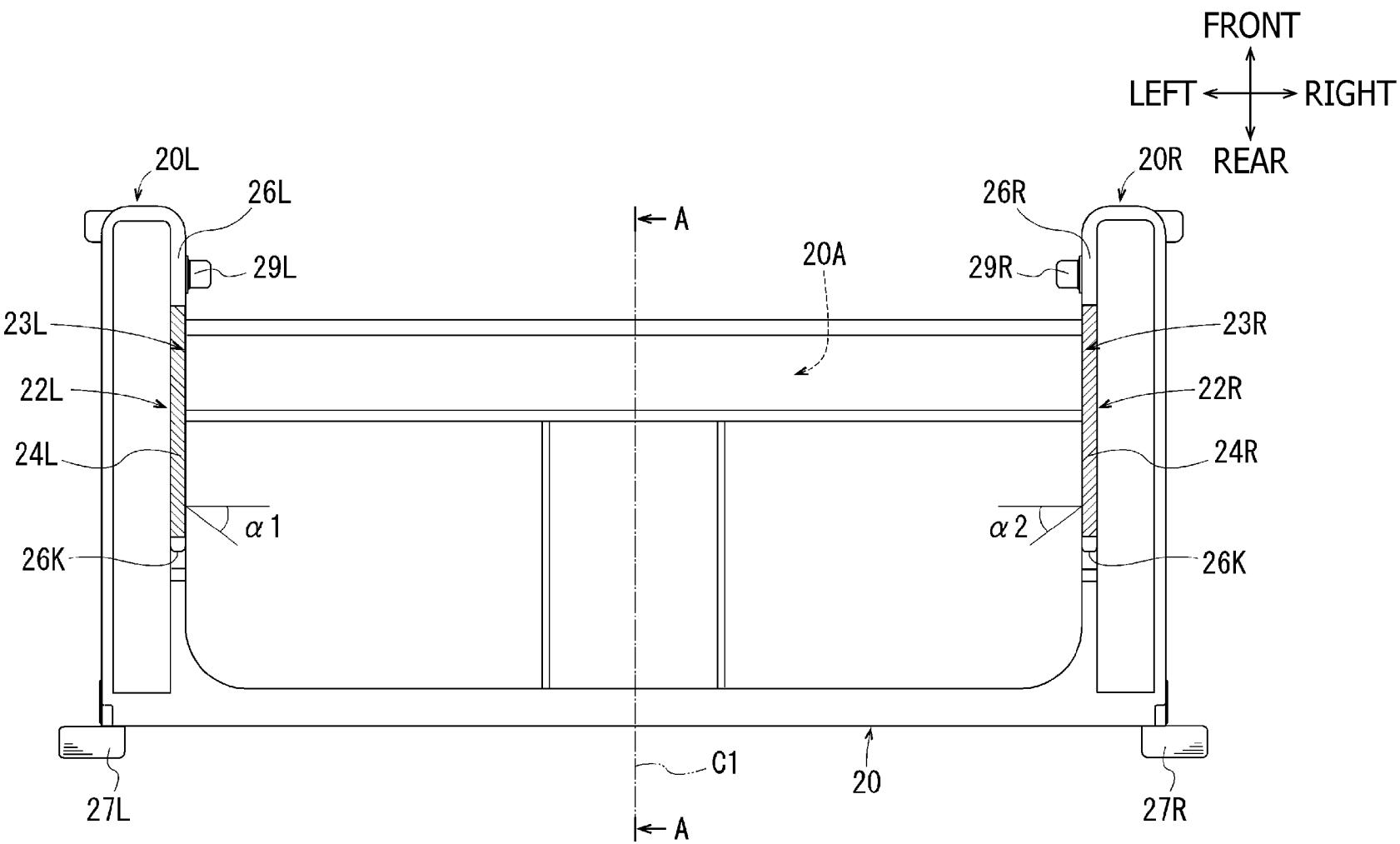
FIG. 6 is a bottom plane view of the second tray in the sheet stackable device according to the embodiment of the present disclosure.

The second tray 20 is further formed to have a right-side edge 20R and a left-side edge 20L, which enhance the lateral sides of the second tray 20 from below. As shown in FIGS. 5 and 6, the right-side edge 20R and the left-side edge 20L extends frontward to partially protrude with respect to a front side of the second tray 20.

As shown in FIGS. 5-7, the right-side edge 20R and the left-side edge 20L are formed to have a plurality of ribs including ribs 26R, 26L. The ribs 26R, 26L extend on inner lateral sides of the right-side edge 20R and the left-side edge 20L respectively along the front-rear direction. Thinly elongated lower planes of the ribs 26R, 26L extend frontward horizontally from the rear side of the second tray 20 and are angled to be higher at front ends. The lower planes of the ribs 26R, 26L include second contact parts 22R, 22L, which can be in slidably contact with the first contact part 11R, 11L respectively. In other words, the second tray 20 includes the second contact parts 22R, 22L, which is slid on the first contact part 11R, 11L when the second tray 20 is slid with respect to the first tray 10, on the lower planes thereof being the opposite plane between the vertically overlapping planes of the first and second trays 10, 20.

As shown in FIGS. 5-7, the second contact parts 22R, 22L are formed to have racks 23R, 23L respectively, in which rack teeth 24R, 24L are arranged along the slidable direction of the second tray 20. In the present embodiment, a virtual center line C1, which extends along the front-rear direction in a midst position between the right and left-side edges 20R, 20L is provided. The center line C1 coincides also with a widthwise center of the sheet placed on the stackable plane 9. In the bottom plane view (see FIG. 6), the rack teeth 24R formed on the right-side edge 20R are angled to orient rearward with respect to the center line C1 at an obliquity angle $\alpha 1$. Meanwhile, the rack teeth 24L formed on the left-side edge 20L are angled to orient rearward with respect to the center line C1 at an obliquity angle $\alpha 2$. The obliquity angles $\alpha 1$, $\alpha 2$ are equivalent, and the rack teeth 24R and the rack teeth 24L are aligned symmetrically with respect to the center line C1.

A width and a height of each rack tooth 24R, 24L, and an interval between the teeth may be, for example, 0.1 mm. The obliquity angles $\alpha 1$, $\alpha 2$ may be, for example, 45 degrees.

As shown in FIG. 6, the racks 23R, 23L are formed in large ranges, except for front ends and rear end, in the second contact parts 22R, 22L. Further, as shown in FIGS. 6 and 7, the second contact parts 22R, 22L include cutouts 26K, which are open upwardly, in rear areas thereof.

The rear edge of the second tray 20 may be in contact with the stoppers 15S in the first tray 10 to stop the second tray 20 in the first position (see FIG. 7). When the second tray 20 is placed in the correct first position with respect to the first tray 10, the second contact parts 22R, 22L of the second tray 20 are in contact with the bottom plane 15 of the first tray 10.

When the second tray 20 is drawn frontward from the first position, the second contact parts 22R, 22L slide on the first contact parts 11R, 11L (see FIG. 8). In this regard, in a large part of the slidable range in the second tray 20, the racks 23R, 23L are in line or point contact with the plane-formed first contact parts 11R, 11L via the rack tooth 24R, 24L. Therefore, unlike the conventional slidable sheet stackable trays, which are mutually slidable at the plane-formed parts respectively, unpleasant noise such as squeaky frictional noise in high-frequency may be reduced.

When the second tray 20 is drawn further frontward, the second tray 20 is caught by the outer rim 16 via the cutouts 26K, which are formed in the rear ends of the second contact parts 22R, 22L (see FIG. 9). Thus, the second tray 20 is placed in the correct second position with respect to the first tray 10.

When the second tray 20 is slidably pushed rearward from the second position to the first position, the second tray 20 is in line or point contact with the planar first contact parts 11R, 11L via the rack teeth 24R, 24L. Therefore, the unpleasant frictional noise may be also reduced.

As has been described above, therefore, the printer 1 according to the embodiment can reduce the unpleasant noise which may be produced when the first and the second trays 10, 20 are used.

In the printer 1 according to the embodiment, the second tray 20 being slidable is guided evenly by the first contact parts 11R, 11L, which are in the right-side and left-side end portions 10R, 10L, and the second contact parts 22R, 22L, which are in the right-side and left-side edges 20R, 20L. Therefore, the second tray 20 can be smoothly guided, and the unpleasant frictional noise can be effectively reduced.

In the printer 1 according to the embodiment, the rack teeth R on the right-hand side and the rack teeth L on the left-hand side are angled line-symmetrically with respect to the center line C1. Therefore, contact areas for the rack teeth 24R, 24L with the first contact parts 11L, 11R can be reduced, and the noise which can be produced by the friction can be reduced. Moreover, due to the line-symmetrical arrangement, thrust force along the right-left direction caused by the rack teeth 24L and thrust force along the right-left direction caused by the rack teeth 24R offset each other. More specifically, when the second tray 20 is slid rearward from the second position toward the first position, thrust force F1 (see FIG. 5) to direct the second tray 20 rightward is generated by the inclination of the rack teeth 24L on the left-hand side. Meanwhile, thrust force F2 (see FIG. 5) to direct the second tray 20 leftward is generated by the inclination of the rack teeth 24R on the right-hand side. However, the thrust forces F1, F2 offset each other. As a result, the second tray 20 tends to be moved straight along the center line C1 and can be prevented from being skewed with respect to the center line C1. Thus, the second tray 20 can be moved to the first position smoothly, and the unpleasant frictional noise can be effectively reduced.

In the printer 1 according to the embodiment, with the housing 8, the image forming unit 7, and the sheet conveyer 5, an image can be formed on the manually-fed sheets which are stacked on the stackable plane 9 including the first tray 10 and the second tray 20. Thus, the second tray 20 is slidable with respect to the first tray 10 when image forming on the manually-fed sheets is required. Therefore, according to the embodiment, the user can enjoy the noise-reducible advantage of the printer 1.

In the embodiment, when the second tray 20 is viewed from bottom (see FIG. 6), the rack teeth 24L are angled to have left-side edges thereof in frontward positions with respect to right-side edges, and the rack teeth 24R are arranged to have right-side edges thereof in frontward positions with respect to left-side edges. However, the rack teeth 24R, 24L may not necessarily be angled in the above-described arrangement. Alternatively, the rack teeth 24L may be angled to have right-side edges thereof in frontward positions with respect to left-side edges, and the rack teeth 24R may be arranged to have left-side edges thereof in frontward positions with respect to right-side edges. In this arrangement, the contact areas for the rack teeth 24R, 24L with the first contact parts 11R, 11L can be reduced to be smaller than contact areas for rack teeth, which are not angled with respect to the right-left direction. Therefore, the unpleasant frictional noise can be reduced.

Another Embodiment

Another embodiment of the present disclosure will be described hereinbelow. The printer 1 in the present embodiment is configured similarly to the printer 1 described in the previous embodiment except for the configuration described below. Description of the components which are common between the printers 1 in the previous embodiment and the present embodiment is herein omitted.

Figure 10:
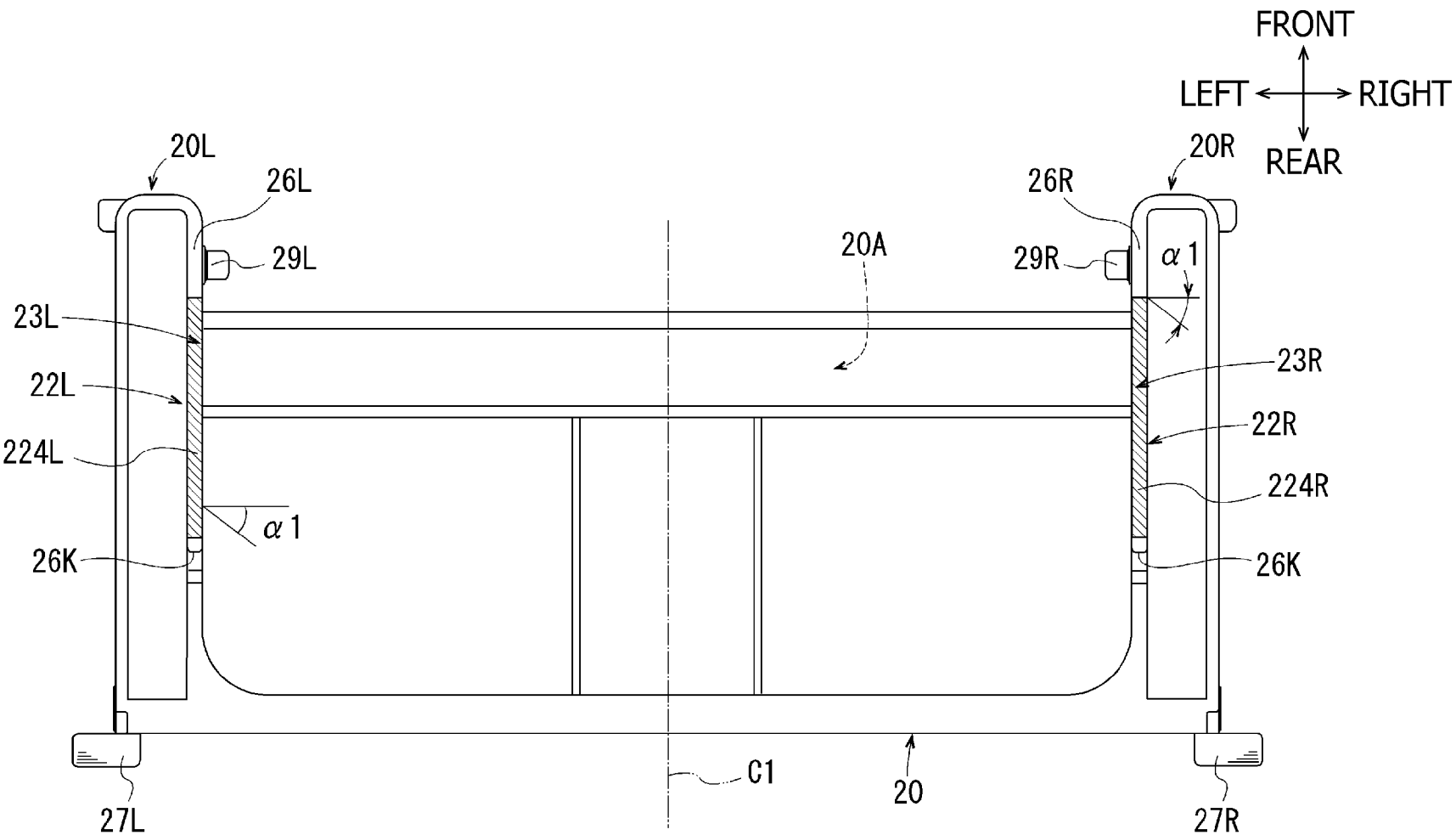
FIG. 10 is a bottom plane view of the second tray in the sheet stackable device according to another embodiment of the present disclosure.

The printer 1 according to the present embodiment has rack teeth 224R in the right-side edge 20R and rack teeth 224L in the left-side edge 20L in the second tray 20 (see FIG. 10). The rack teeth 224R are angled to oblique at the angle $\alpha$1 with respect to the right-left direction, similarly to the rack teeth 224L. In other words, the rack teeth 224R and the rack teeth 224L are angled in the same direction and in the same inclination with respect to the right-left direction.

With the rack teeth 224R, 224L, still the contact areas for the rack teeth 224R, 224L with the first contact parts 11L, 11R can be reduced, and the noise which can be produced by the friction can be reduced.

Even in the present embodiment, the rack teeth 224R, 224L may not necessarily be angled in the above-described arrangement. Alternatively, the rack teeth 224L may be angled to have left-side edges thereof in rearward positions with respect to right-side edges, when viewed from bottom, and the rack teeth 224R may be arranged to have left-side edges thereof in rearward positions with respect to right-side edges.

Although examples of carrying out the disclosure have been described, those skilled in the art will appreciate that there are numerous variations and permutations of the sheet stackable device that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the first tray 10 and the second tray 20 may have solely a single first contact part and a single second contact part in a widthwise central position. For another example, the image forming unit 3 may be replaced with an image reading unit, and the printer 1 may be an image scanner. For another example, the discharge tray 8B may be formed similarly to the first tray 10 to serve as the first tray 10 in the above embodiments, and a second tray to serve as the second tray 20, which is movable between the first position and the second position, may be provided.

For another example, the rack teeth 24R, 24L (224R, 224L) may not necessarily formed in the second contact parts 22R, 22L but may be formed in the first contact parts 10R, 10L in the first tray 10. For another example, the rack teeth 24R, 24L (224R, 224L) may be formed in both the second contact parts 22R, 22L and the first contact parts 11R, 11L.

What is claimed is:

1. A sheet stackable device having a sheet stackable plane, which is configured such that a sheet is placed thereon, comprising:

a first tray formed in a shape of a flat plate and comprising a first contact part;

a second tray formed in a shape of a flat plate, configured to be supported by the first tray to be slidable along a slidable direction between a first position, in which the second tray overlaps the first tray, and a second position, in which the second tray is drawn out of the first tray, comprising a second contact part, which is slidable on the first contact part, at least one of the first contact part and the second contact part including a rack with rack teeth, which are aligned along the slidable direction, and an upper plane of the first tray and an upper plane of the second tray in the second position forming at least a part of the stackable plane; and a housing configured to support the first tray, wherein the first tray is configured to be openable and closable with respect to the housing key rotating about a shaft;

wherein the first tray comprises a guide rail configured to slidably guide the second tray; and wherein the second contact part is formed in a position farther from the shaft of the first tray with respect to a guided part, at which the second tray is guided by the guide rail of the first tray.

2. The sheet stackable device according to claim 1, wherein each tooth in the rack teeth is angled to incline with respect to a widthwise direction, which is orthogonal to the slidable direction.

3. The sheet stackable device according to claim 1, wherein the first contact part and the second contact part are arranged on each widthwise edge of the first tray and the second tray respectively in a widthwise direction, which is orthogonal to the slidable direction; and wherein the rack is provided in the at least one of the first contact part and the second contact part, which are arranged in the each widthwise edge.

4. The sheet stackable device according to claim 3, wherein the rack teeth, which are formed in the rack arranged on one of the widthwise edges of the at least one of the first tray and the second tray, and the rack teeth, which are formed in the rack arranged on the other of the widthwise edges of the at least one of the first tray and the second tray, are angled to incline with respect to the widthwise direction and line-symmetrically with respect to a center line, the center line being in a midst position between the widthwise edges of the at least one of the first tray and the second tray.

5. The sheet stackable device according to claim 3, wherein the rack teeth, which are formed in the rack arranged on one of the widthwise edges of the at least one of the first tray and the second tray, and the rack teeth, which are formed in the rack arranged on the other of the widthwise edges of the at least one of the first tray and the second tray, are angled with respect to the widthwise direction at a same inclination to orient a same direction.

6. The sheet stackable device according to claim 1, wherein the first contact part included in the first tray is arranged on one of an upper plane and a lower plane of the first tray; and wherein the second contact part included in the second tray is arranged on a plane, which is opposite from the one of the upper plane and the lower plane of the first tray.

7. The sheet stackable device according to claim 1, further comprising:

a processing unit arranged in the housing and configured to apply a process to the sheet; and a conveyer unit configured to convey the sheet along a conveying direction, which is in parallel with the slidable direction, in order to feed the sheet placed in the sheet stackable device to the processing unit or discharge the sheet processed in the processing unit to the stackable device.

8. The sheet stackable device according to claim 1, wherein the first contact part is included in an upper plane of an outer rim, which protrudes upward from a bottom plane of the first tray and extends along a widthwise direction being orthogonal to the slidable direction; and wherein the second contact part is included in a lower plane of a rib, which protrudes downward from a bottom plane of the second tray and extends along the slidable direction.

9. The sheet stackable device according to claim 1, wherein the first tray is swingably supported by a side plane of the housing to be swingable between a covering position, in which the first tray is in an upright posture to align the side plane of the housing, and a second position, in which the first tray protrudes from the side plane in a sidelong posture.

10. The sheet stackable device according to claim 1, wherein the second part is formed in a rib, which extends along the slidable direction of the second tray and protrudes downward from a lower plane of the second tray.

11. The sheet stackable device according to claim 1, wherein the first contact part is formed in a shape of a rib extending along a widthwise direction, which is orthogonal to the slidable direction.

12. The sheet stackable device according to claim 11, wherein the first contact part is a part of a rim, which fences an edge of the first tray.

13. An image processing apparatus, comprising:

a housing;

a sheet stackable device configured to be openable and closable with respect to the housing and configured such that a sheet is placed thereon;

a sheet conveyer configured to convey the sheet; and an image processing unit configured to process an image in conjunction with the sheet being conveyed, wherein the sheet stackable device comprises:

a first tray configured to be swingably supported by the housing, and a second tray configured to be slidably supported by the first tray, wherein the second tray is formed to have a rib, which extends along a slidable direction of the second tray and protrudes downward from a lower plane of the second tray, and wherein a lower plane of the rib is formed to have a rack with rack teeth, which are angled with respect to a direction orthogonal to the slidable direction, the rack being configured to be slidably in contact with the first tray.

14. The image processing apparatus according to claim 13, wherein the first tray comprises a guide part configured to slidably guide the second tray; and wherein the second tray is formed to have a supported part, which is configured to be supported by the guide part.

15. The image processing apparatus according to claim 14, wherein the rib is formed to have a dent, which dents upwardly, in a position closer to the supported part with respect to the rack; and wherein the dent contacts the first tray when the second tray is slidably moved with respect to the first tray.

* * * * *

UNITED STATES PATENT AND TRADEMARK OFFICE

CERTIFICATE OF CORRECTION

PATENT NO. : 8,690,147 B2
APPLICATION NO. : 13/537230
DATED : April 8, 2014
INVENTOR(S) : Hiroyuki Okuchi et al.

It is certified that error appears in the above-identified patent and that said Letters Patent is hereby corrected as shown below:

Claims

Column 9, Claim 1, Line 13:
Please delete “key” and insert --by--

Signed and Sealed this
Eighth Day of December, 2015

Michelle K. Lee

Michelle K. Lee
*Director of the United States Patent and Trademark Office*